US007526927B2

(12) United States Patent
Pinto

(10) Patent No.: US 7,526,927 B2
(45) Date of Patent: May 5, 2009

(54) STAMPED HOLLOW RING DESIGN

(75) Inventor: Anthony Pinto, White Plains, NY (US)

(73) Assignee: Sandberg & Sikorski Corporation, New York, NY (US)

( * ) Notice: Subject to any disclaimer, the term of this patent is extended or adjusted under 35 U.S.C. 154(b) by 0 days.

(21) Appl. No.: 11/827,417

(22) Filed: Jul. 11, 2007

(65) Prior Publication Data

US 2007/0256451 A1 Nov. 8, 2007

(51) Int. Cl.
*A44C 9/00* (2006.01)

(52) U.S. Cl. ..... 63/15; D11/26

(58) Field of Classification Search ..... None
See application file for complete search history.

(56) References Cited

U.S. PATENT DOCUMENTS 774,700 A * 11/1904 Schmidt ..... 63/15
1,479,842 A 1/1924 Sweitzer
1,596,628 A 8/1926 Israel
1,740,369 A 12/1929 Peters
1,947,254 A 2/1934 Foster
2,035,562 A 3/1936 Minister
5,718,278 A 2/1998 Baum
5,916,271 A 6/1999 Baum
5,979,537 A 11/1999 Baum
6,032,719 A 3/2000 Baum
6,116,053 A 9/2000 Siebenberg
6,123,141 A 9/2000 Baum
6,554,052 B2 4/2003 Hashimian
6,701,618 B2 3/2004 Gefen

* cited by examiner

*Primary Examiner*—Jack W. Lavinder
(74) *Attorney, Agent, or Firm*—Gottlieb, Rackman & Reisman

(57) ABSTRACT

A hollow ring design which may be formed by stamping a shank and stamping a top piece is provided. The shank is formed with a comfort fit, such as a convex configuration, along its inside surface and with a non-planar recess, such as a concave, rectangular or square hollow configuration, at least along a portion of its outside surface. A top piece is also stamped along its inside surface and is thus formed with non-planar recess, such as a concave, rectangular or square hollow configuration, opposite that of the recess of the shank. The top piece is configured and sized to fit onto the shank without any need to force fit one piece to the other, while at the same time forming an arcuate channel inside the ring to reduce the cost of materials.

10 Claims, 8 Drawing Sheets

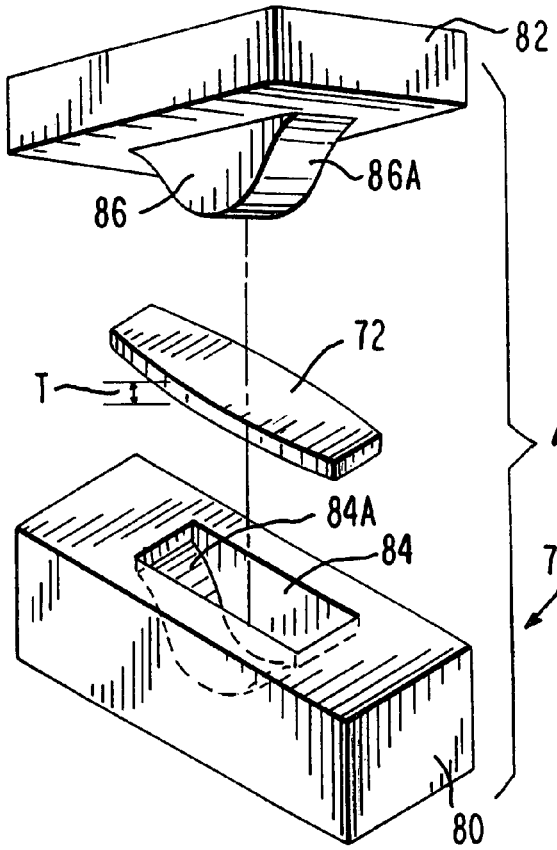
FIG. 11
FIG. 12
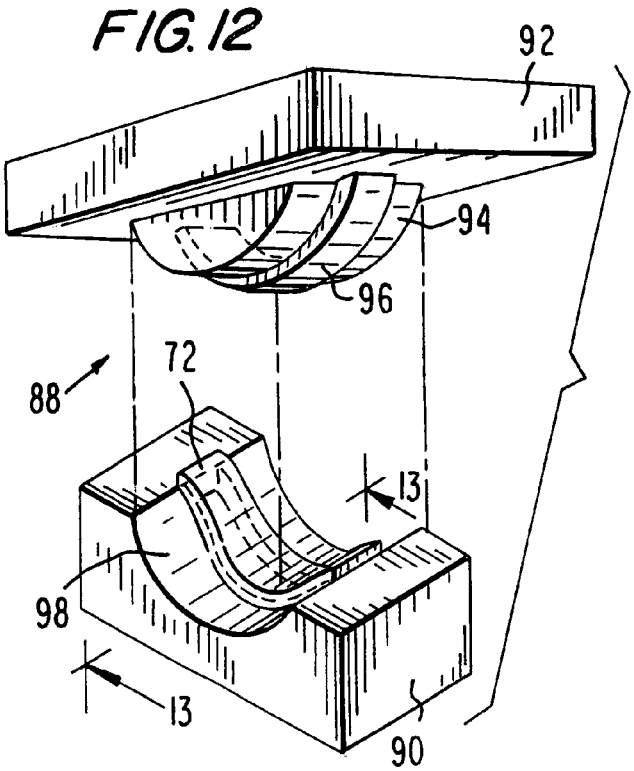
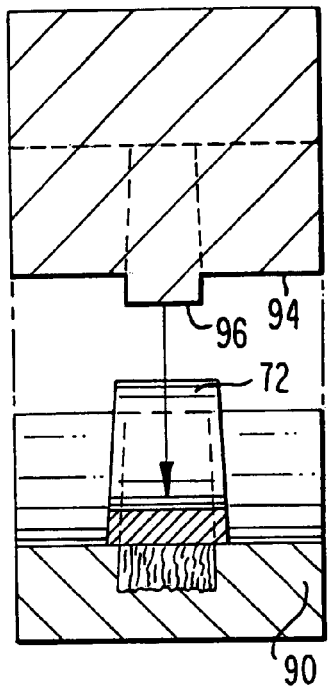
FIG. 13

FIG. 20
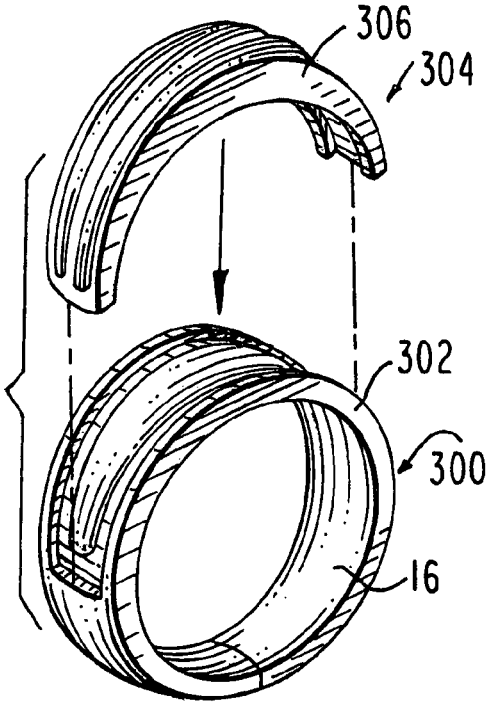
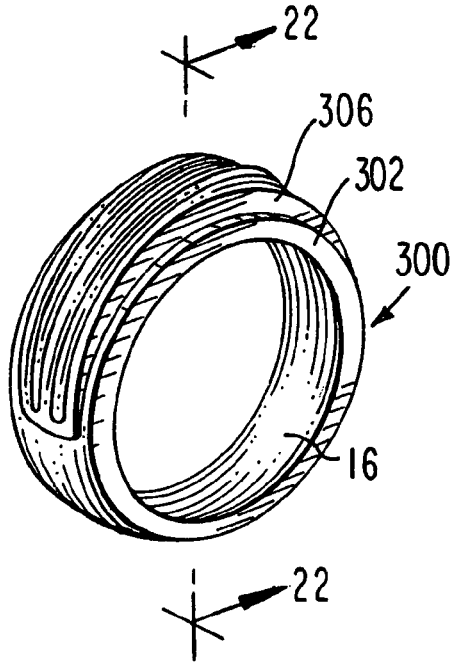
FIG. 21
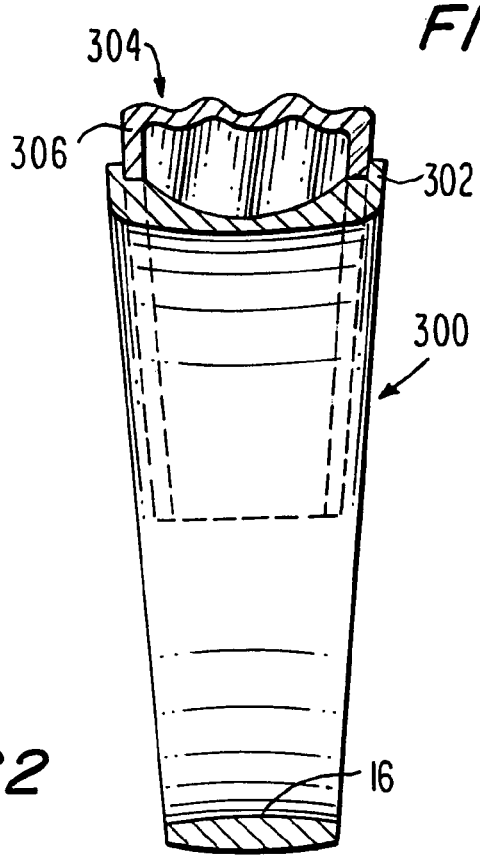
FIG. 22

STAMPED HOLLOW RING DESIGN

This application claims priority of provisional application No. 60/624,975, which was filed on Nov. 4, 2004.

BACKGROUND OF THE INVENTION

1. Field of the Invention

This invention relates generally to ring designs and, more particularly, to a stamped hollow ring design having a comfort fit.

2. Background

It is well known in the art to provide a hollow ring design including, but not limited to, a hollow ring design having a comfort fit. For example, several patents in the name of Robert Baum, including U.S. Pat. Nos. 5,718,278, 5,916,271, 5,979,534, 6,032,719 and 6,123,141, disclose a hollow jewelry ring having a comfort fit which is formed by investment casting. While investment casting has several advantages, it suffers from the fact that the finally-formed ring has relatively "thick" components, resulting in more expensive materials than if stamping were utilized.

Stamping of a hollow ring design is also known as indicated by the patent to Gefen, U.S. Pat. No. 6,701,618. In the Gefen '618 patent, a two-piece ring is provided having an inner ring portion and an outer ring portion. Each portion may be formed by stamping or casting. According to the method of the Gefen patent, the inner ring portion is placed inside the outer ring portion, and then the inner ring portion is expanded so as to be force fit into the outer ring portion. Such force fitting is difficult to accomplish, is time consuming and oftentimes provides a less than satisfactory finished product.

The patent to Siebenberg, U.S. Pat. No. 6,116,053, discloses a method of manufacturing a seamless hollow comfort fit ring, such as a wedding band, in which ring-size "washers" are punched out at a press-machine. The washers are then soldered together at their outside edges to form a comfort fit wedding band. While Siebenberg discloses the very broad concept of stamping a ring with a comfort fit, his ring does not provide a fully formed shank which cooperates with a smaller outside top piece in order to provide a myriad number of design alternatives for the ultimately formed ring. Moreover, because of the method used to form the ring in Siebenberg, extensive soldering and finishing along each side of the ring is required.

In view of the above limitations and problems, one object of the present invention is to provide a hollow ring design, having a comfort fit, which may be formed by stamping the shank and stamping the top piece, while avoiding the problems and disadvantages of the prior art.

Yet another object of the present invention is to provide a hollow ring design, having a comfort fit, which does not require casting but which can be stamped to thereby form the ring in an efficient and cost-reduced manner.

Yet another object of the present invention is to provide a hollow ring design, having a comfort fit, which does not require force fitting the shank to the top piece of the ring.

Another object of the present invention is to provide a hollow ring design, having a comfort fit, which does not require excessive welding or soldering.

Still other objects of the present invention will be obvious and/or apparent from the following description.

SUMMARY OF THE INVENTION

These and other objects of the present invention are attained by providing a hollow ring design, having a comfort fit, formed by stamping the shank and the top piece of the ring. The shank is formed with a comfort fit, such as a convex configuration, along its inside surface and with a non-planar recess, such as a concave, rectangular or square hollow configuration, at least along a portion of its outside surface. A top piece is also stamped along its inside surface and is thus formed with non-planar recess, such as a concave, rectangular or square hollow configuration, opposite that of the recess of the shank. The top piece is configured and sized to fit onto the shank without any need to force fit one piece to the other, while at the same time forming an arcuate channel inside the ring to reduce the cost of materials.

According to one embodiment of the present invention, the top piece has side walls depending from its inside surface and generally coextensive with the outside surface of the shank, and with the side walls forming part of the side of the finished ring in order to provide a borderless ring design. According to another embodiment of the invention, the top piece, although having depending side walls, is somewhat narrower than the shank and the top piece is formed with side walls generally adjacent the non-planar recess of the shank, so that the final ring housing has a border design.

BRIEF DESCRIPTION OF THE DRAWINGS

For a more complete understanding of the invention, reference is made to the following description, when considered in conjunction with the following drawings, wherein:

FIG. 11 shows a die used to bend the top piece of the ring of the present invention, with the components in an exploded configuration to show the details thereof;

FIG. 12 shows a die of the present invention used to form the hollow portion in the top piece, with the mold exploded to show the details thereof;

FIG. 13 is a view taken along the line 13-13 of FIG. 12;

FIG. 20 shows a view similar to that of FIG. 16, but illustrating another embodiment of the ring of the present invention formed to include a shank border;

FIG. 21 shows the alternative embodiment of the present invention of FIG. 20 after the components have been soldered and/or welded together and then finished; and FIG. 22 is a view taken along the line 22-22 of FIG. 21, and enlarged in scale.

DETAILED DESCRIPTION

Figure 1:
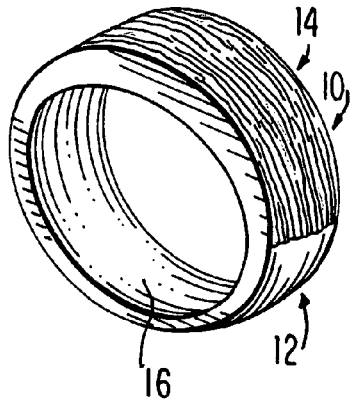
FIG. 1 is a perspective view of a stamped hollow ring according to one embodiment of the present invention.
Figure 3:
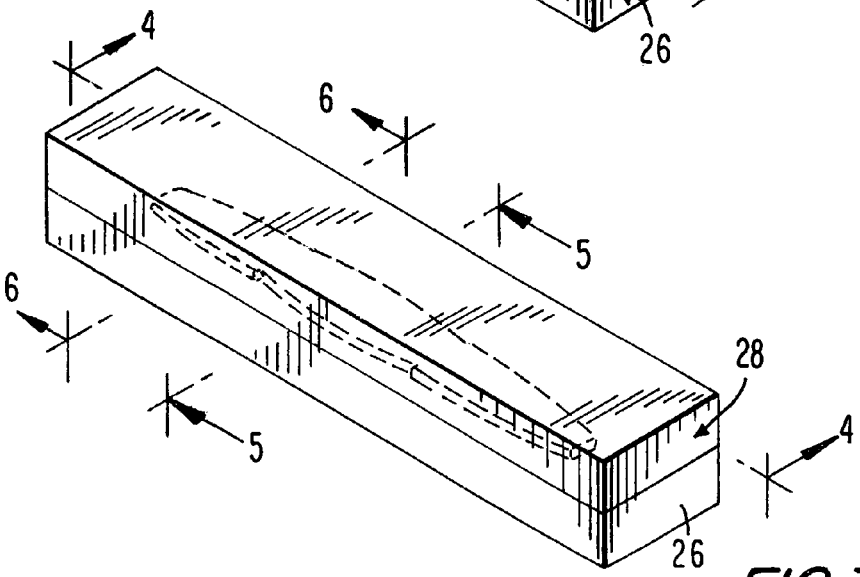
FIG. 3 shows the die of FIG. 2B, but in a closed condition.

Referring now to the drawings, and more particularly to FIG. 1 thereof, an article of jewelry in accordance with the present invention is shown. In the embodiment shown, the article of jewelry is in the form of a ring 10 having a shank 12 and a top piece 14. Shank 12 is formed with a so-called comfort fit along the portion of the shank adjacent a wearer's finger. In other words, surface 16 forming the comfort fit is generally convex in shape.

Figure 2B:
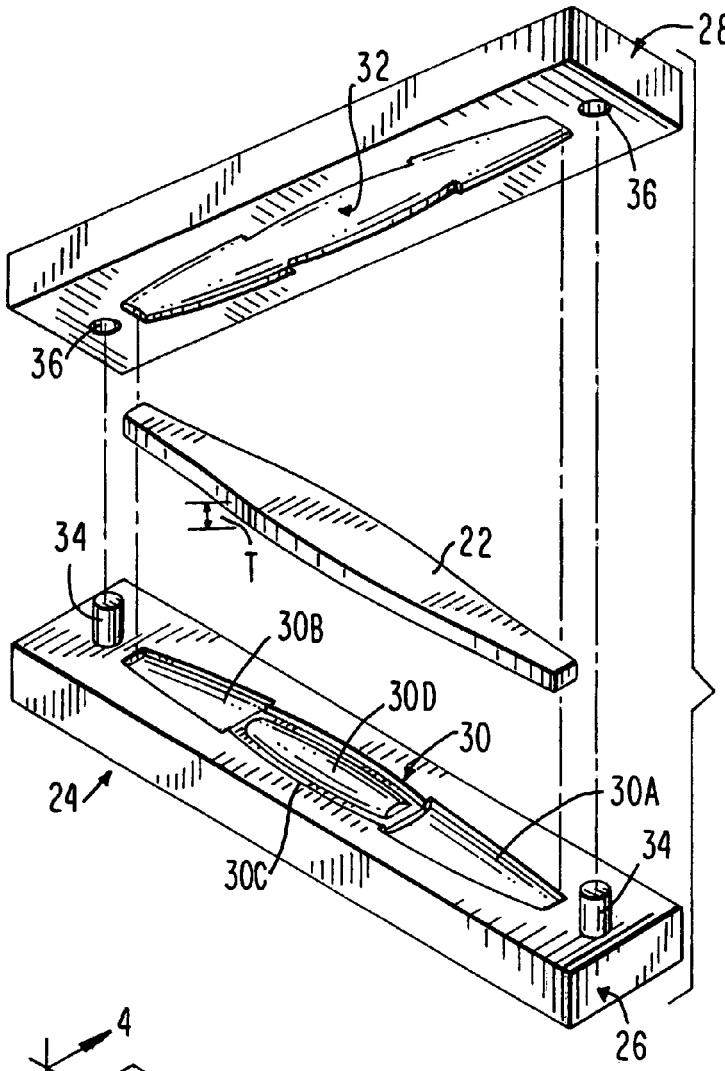
FIG. 2B shows a die used in forming the shank of the ring of FIG. 1, with the components in an exploded configuration to show the details thereof, and with the shank not yet bended.
Figures 2A, 11A:
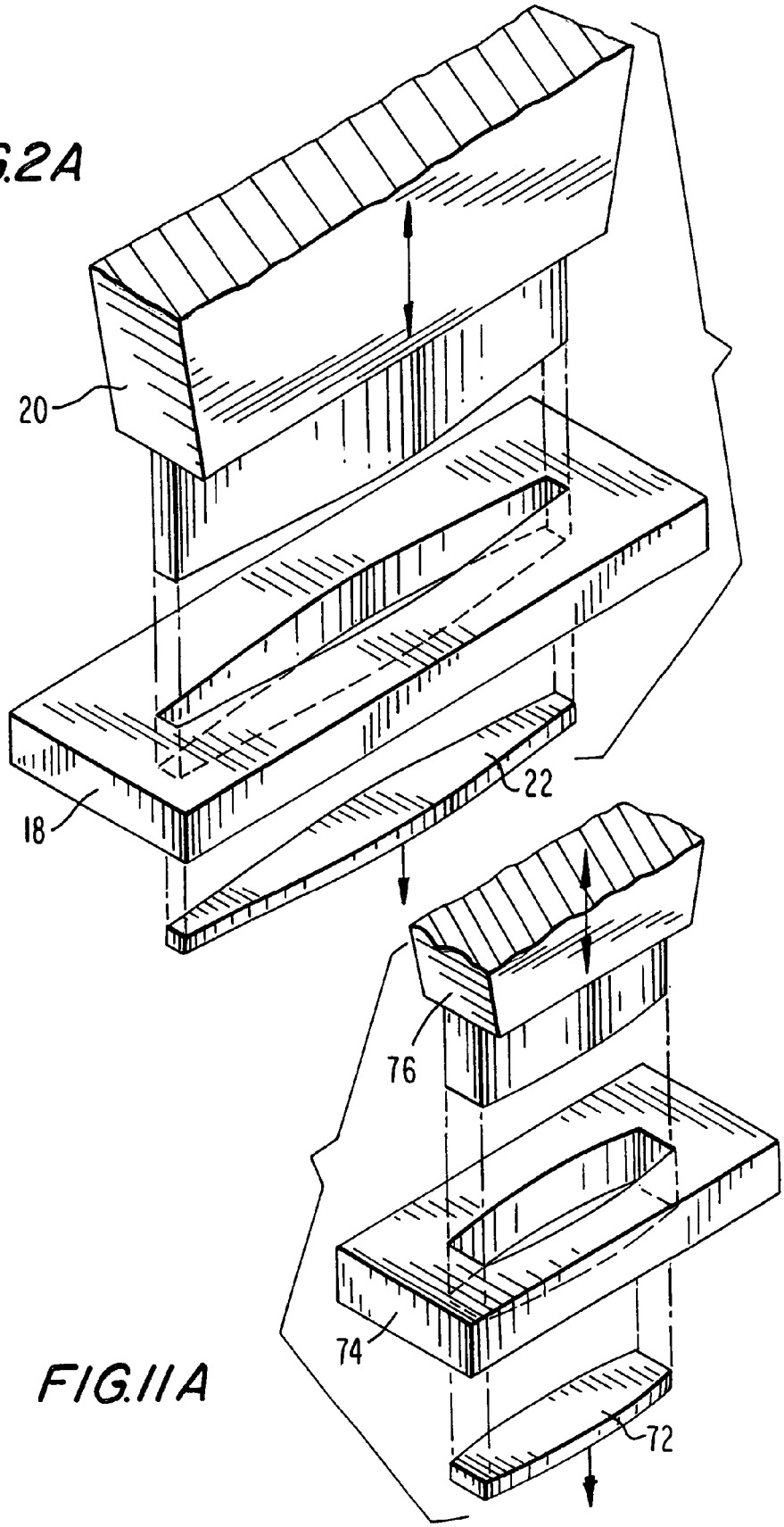
FIG. 2A shows a trim plate and trim punch for forming the blank used to form the shank of the ring of FIG. 1, with the components in an exploded configuration to show the details thereof.
FIG. 11A shows a trim plate and trim punch for forming the blank used to form the top piece of the ring of FIG. 1, with the components in an exploded configuration to show the details thereof.

FIG. 2A shows a trim plate 18 which receives a trim punch 20 to form a blank 22 from a flat bar of material (not shown), in order to eventually form shank 12.

FIG. 2B shows a die 24 utilized in stamping shank 12. More particularly, die 24, which receives blank 22, has a bottom die piece 26 and a top force fit die piece 28. As shown in FIG. 2B, bottom die piece 26 defines a cavity 30 having respective cavity ends 30A and 30B and a central portion 30C. Central portion 30C of cavity 30 includes an elongated member 30D which is used to form the generally hollow inner portion of shank 12.

In the particular embodiment shown, elongated member 30D is convex in configuration, thereby forming a part or segment of shank 12 with a recess having a concave shape, as described hereinafter. By forming elongated member 30D in other shapes, such as rectangular or square in cross-section, the recess of shank 12 can be provided with a corresponding rectangular or square shape.

Figure 4:
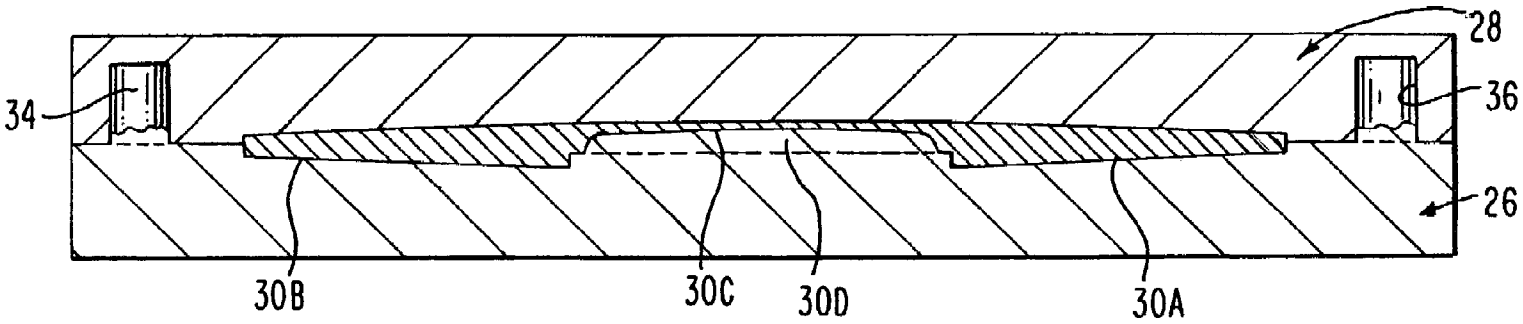
FIG. 4 is a view taken along the line 4-4 of FIG. 3, but enlarged in scale.

Top force fit die piece 28 defines an elongated concave cavity 32 which cooperates with cavity 30 of bottom die piece 26 to shape shank 12 from blank 22 as the two pieces come together. In order to provide proper alignment of cavity 30 and cavity 32, bottom die piece 26 of die 24 includes depending pegs 34 which are selectively received within holes 36 of top die piece 28, thereby keeping bottom die piece 26 and top force fit piece 28 in registry (see FIG. 2B and FIG. 4).

Figure 6:
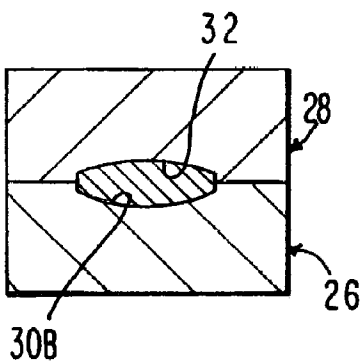
FIG. 6 is a view taken along the line 6-6 of FIG. 3, but enlarged in scale.
Figure 5:
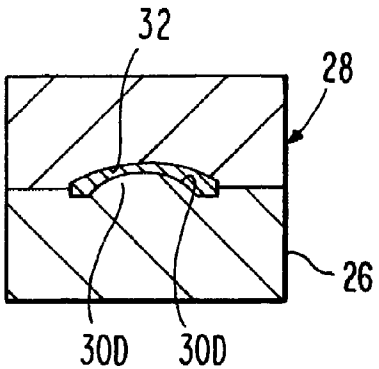
FIG. 5 is a view taken along the line 5-5 of FIG. 3, but enlarged in scale.

In order to provide a comfort fit along surface 16 for shank 12, cavity 32 of top die piece 28 is rounded or concave in cross-section (see FIG. 5 and FIG. 6). Thus, as shank 12 is formed, it is stamped to provide a curved convex shape on the side which eventually is next to the finger of a wearer.

Figure 7:
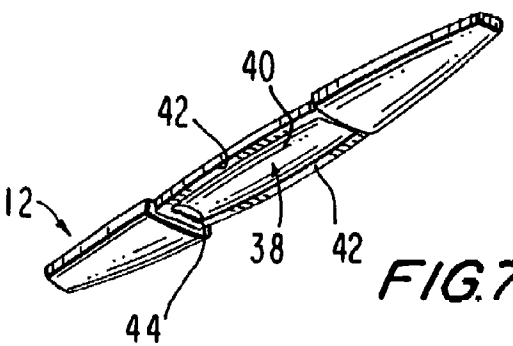
FIG. 7 shows the shank of the present invention in a flat configuration prior to being bended.

FIG. 7 illustrates shank 12 of the present invention, which has been formed from blank 22, but still showing the shank in a flat configuration. In this regard, shank 12 has an elongated recess 38 along the mid-part or mid-segment thereof and defined by a concave surface 40, side walls 42 and end walls 44.

Figure 8:
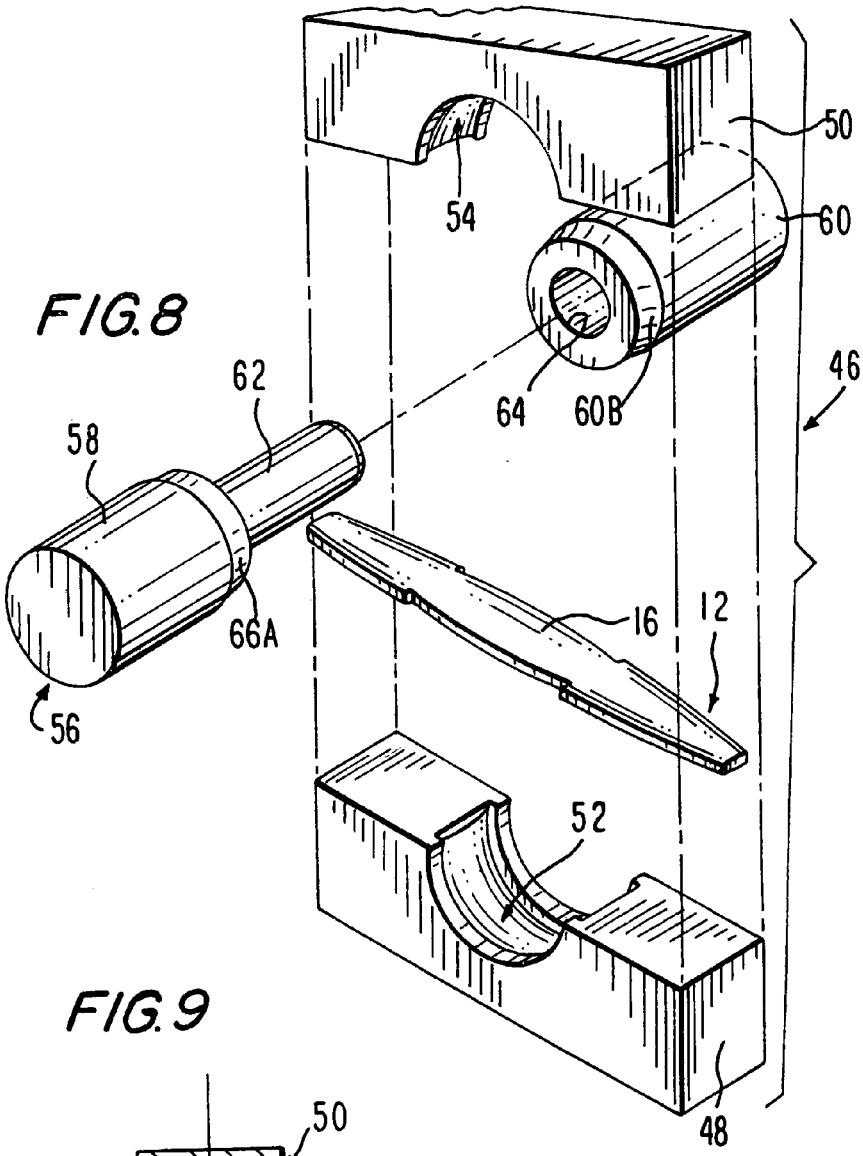
FIG. 8 shows a mold for bending the shank, showing the mold in an exploded configuration.

In order to "round" shank 12, a rounding die 46 illustrated in FIG. 8 is used. Rounding die 46 includes a bottom die piece 48 and a top force fit die piece 50 defining, respectively, rounding surfaces 52 and 54. Rounding die 46 also includes a plug assembly 56 having a male member 58 and a female member 60 cooperating with each other such that a cylindrical portion 62 of male member 58 is insertable into a cylindrical bore 64 of female member 60.

Figure 9:
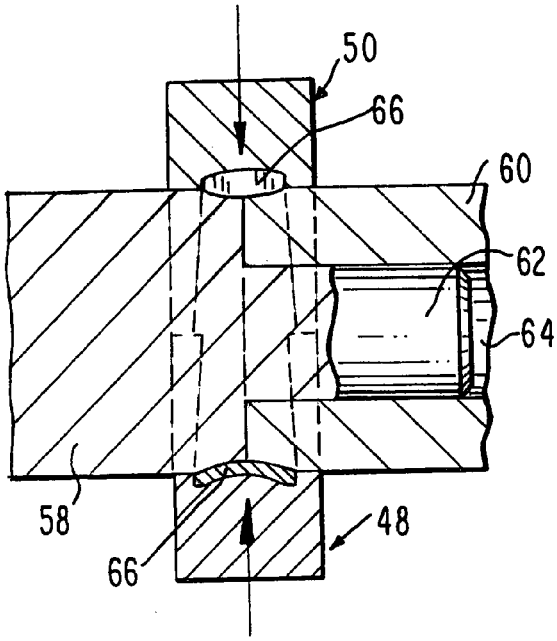
FIG. 9 shows a cross-section of the mold of FIG. 8, but with the mold in a closed configuration.

As shown in FIG. 9, when male member 58 is inserted into female member 60, the plug assembly 56 defines an outside annular curved portion 66 formed by outside surfaces 66A and 66B of male member 58 and female member 60 respectively (see FIG. 8). This enables the convex shaped inner surface 16 of shank 12 to maintain its shape, as shank 12 wraps around plug assembly 56 in order to "round" the shank during production.

Figure 10:
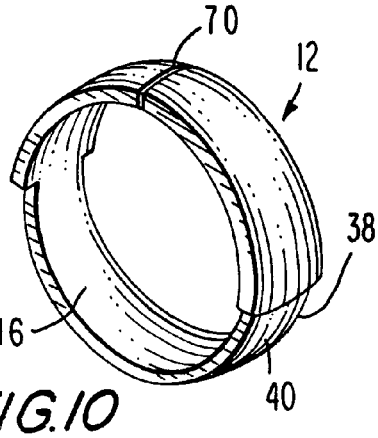
FIG. 10 shows the shank of the present invention, as bended by the mold of FIG. 8.

FIG. 10 illustrates shank 12 after it has been removed from rounding die 46, thereby exposing concave surface 40 formed in recess 38 of the shank mid-segment. At this time, ends 70 of the shank may be welded and/or soldered together.

Formation of the top piece of the ring will now be described, starting with FIG. 11A. In this figure, top piece blank 72 is stamped from an appropriate sheet of larger material (not shown) by virtue of bottom trim plate 74 and top trim punch 76.

After blank 72 has been formed, it is then inserted into a pre-bend die 78 (FIG. 11) having a bottom pre-bend die piece 80 and a top pre-bend force piece 82. Pre-bend die piece 80 defines a female cavity 84 having a curved undulated surface 84A which receives a corresponding male member 86 having a curved undulated surface 86A located on pre-bend force piece 82. Appropriate force is applied to stamping mold 78 in order to pre-bend blank 72 to a shape generally corresponding to the curved shape defined by surface 86A of male member 86 and curved surface 84A of female cavity 84.

Figure 14:
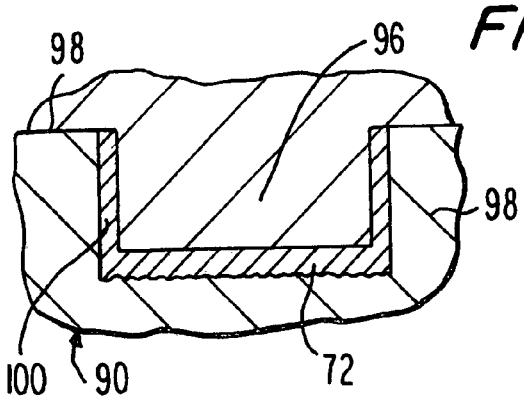
FIG. 14 is an enlarged view, showing the mold of FIG. 12 forming the hollow portion of the top piece of the ring.

After blank 72 has been pre-bent, it is inserted into yet another stamping die 88 defining a bottom die piece 90 and a top force fit piece 92 (FIGS. 12 and 13). In this regard, force fit piece 92 defines a curved male stamping member 94 which carries an outwardly extending annular hollow surface forming member 96. With now-bent blank 72 resting in a curved female portion 98 of bottom die piece 90, as force is applied to force fit piece 92, extending annular member 96 cooperates with a slightly larger cutout 100 (See FIG. 14) along curved female portion 98 of die member 90 (see FIG. 14) in order to form the top piece 14 of the ring from blank 72.

Figure 15:
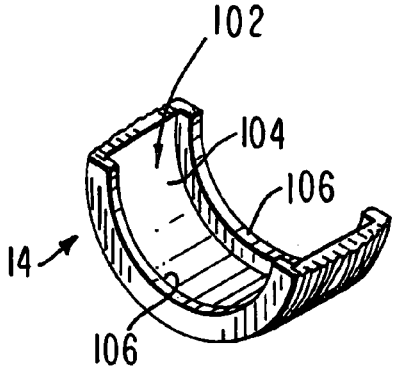
FIG. 15 shows the top piece according to one embodiment of the present invention.

Top piece 14, inverted to show the "inside" thereof, and after removal from stamping die 88, is illustrated in FIG. 15. Top piece 74 includes a recess 102 defined by an inner curved surface 104 and upstanding side walls 106.

Figure 16:
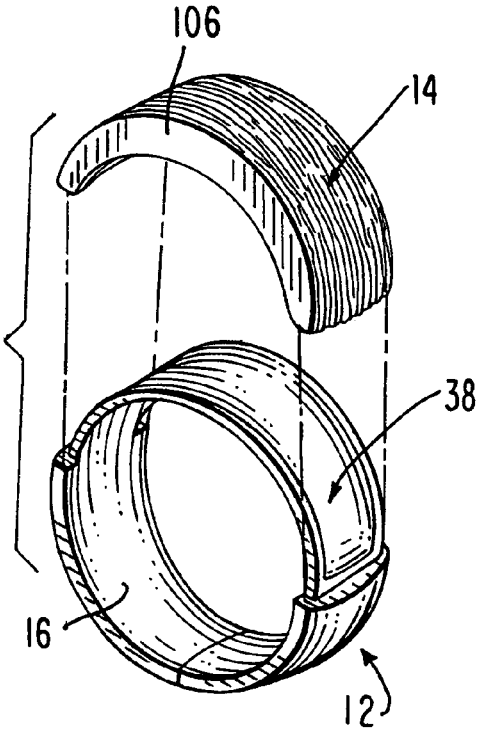
FIG. 16 shows the top piece mating with the shank of the ring.

With top piece 14 now being formed, ring 10 is formed by placing top piece 14 onto shank 12, as illustrated in FIG. 16. In this regard, it is noted that the crown portion of the finished ring is hollow, with this hollow arcuate space for defining a channel between recess 38 of shank 12 and recess 102 of top piece 14. By making the ring hollow, savings in costs of material may be realized. Moreover, there is no need to force-fit the top piece to the shank, further providing efficiency in forming the ring.

Figure 17:
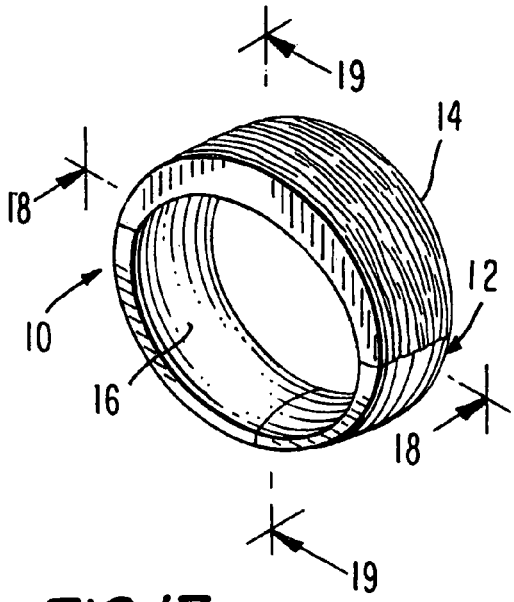
FIG. 17 shows the ring of the present invention, with the components soldered or welded together, but prior to final finishing thereof.

FIG. 17 shows the shank and the top piece which have now been welded or soldered together. The ring may then be buffed and finished to eventually remove the soldering or welding lines which can still be seen in FIG. 17.

Figure 19:
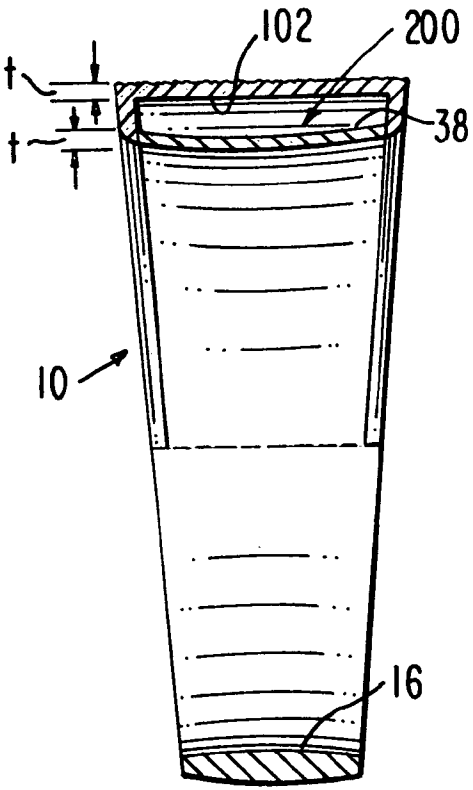
FIG. 19 is a view taken along the line 19-19 of FIG. 17, and enlarged in scale.
Figure 18:
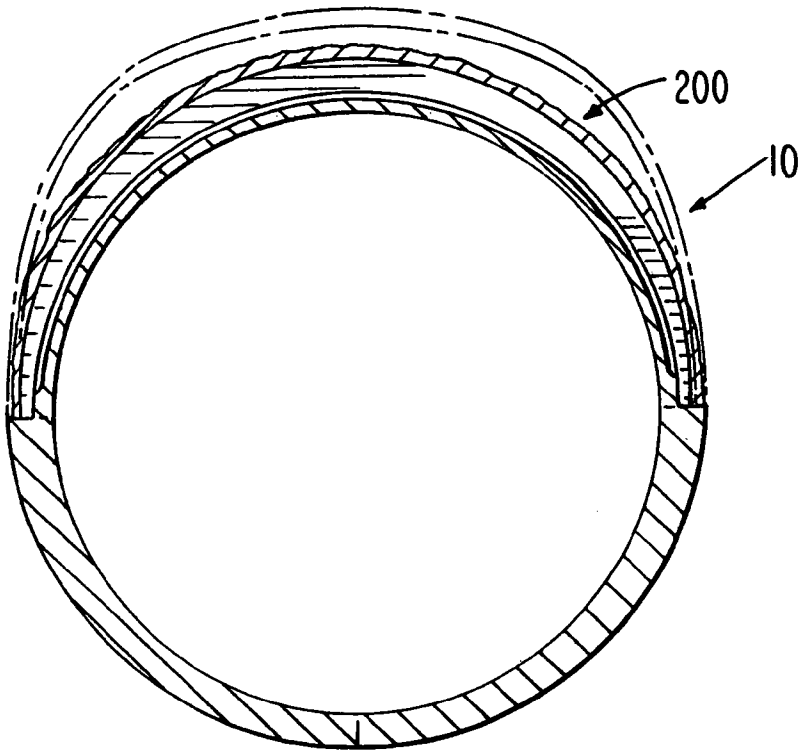
FIG. 18 is a view taken along the line 18-18 of FIG. 17, and enlarged in scale.

FIG. 18 and FIG. 19 show that ring 10 provides a comfort fit along surface 16; it also provides an annular space or channel 200 defined between recesses 38 and 102 of shank 12 and top piece 14, respectively.

FIG. 20, FIG. 21 and FIG. 22 show an alternative embodiment of the invention in which shank 300 is formed with a side wall 302 on either side. Top piece 304 is soldered to the shank. In this embodiment, in which the pieces have generally been formed in the same manner as previously described, the finished ring 300 has a border defined by side wall 302 of the shank and a side wall 306 of top piece 304.

According to the invention, a hollow ring design having a comfort fit is made according to the following method.

A blank is formed by stamping it from suitable material. The blank is inserted into a stamping die in order to form a shank having a comfort fit along one surface thereof and a recess along the opposite surface. The shank is then rounded in a rounding die. The ends of the shank are then welded and/or soldered together.

The top piece of the ring is likewise formed by providing a blank stamped from suitable material. The flat blank is then inserted into a die to pre-bend it. Once pre-bended, a stamping die forms a recess along the inside surface thereof.

The top piece is connected to the shank, such that there is an annular space or channel defined between them, thereby reducing material costs, but not otherwise detracting from the ring as the annular space is not visible. There is no need to snap fit the pieces together. The pieces are welded and/or soldered together.

The ring may then be finished to remove seams formed by the welding or soldering process or otherwise created as the ring is formed.

According to one embodiment, the method provides a ring with a borderless look. In another embodiment, the method creates a ring that has a border.

By utilizing stamping, rings having portions of relatively thin thicknesses may be realized, thereby achieving reduced costs. For example, starting blank 22 and starting blank 72 may have a thickness, T, in the range of from 0.006 inch to 0.181 inch. When formed into the shank and the top piece, respectively, the hollow portions may have a thickness, t, in the range of from 0.006 inch to 0.080 inch and, preferably, in the range from 0.040 inch to 0.060 inch.

The materials for the ring may be gold, platinum and/or silver and the top piece and shank may be of different materials, e.g., the top piece may be platinum and the shank may be gold.

It will thus be seen that the objects set forth above, and those made apparent from the preceding description, are efficiently attained, and since certain changes may be made in the designs set forth above without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described, and all statements of the scope of the invention, which, as a matter of language, might be said to fall therebetween.

The invention claimed is:

1. A composite ring comprising:

a shank defined by a first arcuate segment and a second arcuate segment, each segment having an inner circumferential surface and an outer circumferential surface; the inner circumferential surfaces being continuous to form a circular inner surface and the outer circumferential surface of said first segment being radially offset from the outer circumferential surface of the second segment to form two respective shoulders extending across the width of the shaft, said outer circumferential surface of second arcuate segment having a concave shape extending radially inwardly;

at least one arcuate piece having an inner circumferential surface formed with two upstanding sidewalls and an inner curved surface disposed between said sidewalls to define an elongated recess therealong and an outer circumferential surface bearing a unique visual design, appearance or configuration;

wherein said top piece is constructed to fit over said shank, along said first segment and between said shoulders in order to form a ring, said recess of said top piece overlying said shank for defining an arcuate channel in said ring.

2. The ring of claim 1, wherein said second segment outer surface of said shank is sized and shaped to be flush with the outer surface of said top piece.

3. The ring of claim 1, wherein said channel is concave in configuration.

4. The ring of claim 1, wherein the inner surfaces of each of said arcuate segments are continuous with one another.

5. The ring of claim 1, wherein the inner surfaces of each of said arcuate segments are convex in configuration.

6. The ring of claim 1, wherein said first arcuate segment of said shank has a thickness of between 0.006 and 0.080 inches.

7. The ring of claim 1, wherein said arcuate top piece has a thickness of between 0.006 and 0.080 inches.

8. The composite ring of claim 1 wherein the outer circumferential surface of said top piece is continuous with the outer circumferential surface of said second segment.

9. The composite ring of claim 1 wherein said sidewalls of said top piece are continuous with said first segment.

10. A composite ring system comprising the shank of the composite ring of claim 1 and a plurality of different top pieces, each top piece having a unique design on its outer circumference.

* * * * *